United States Patent [19]

Yates, Jr. et al.

[11] Patent Number: 5,067,568

[45] Date of Patent: Nov. 26, 1991

[54] WELL PERFORATING GUN

[75] Inventors: Donald N. Yates, Jr., Cape Carancahua; William D. Myers, Jr., Houston, both of Tex.

[73] Assignee: Baker Hughes Incorporated, Houston, Tex.

[21] Appl. No.: 514,168

[22] Filed: Apr. 25, 1990

[51] Int. Cl.[5] ..... E21B 43/117

[52] U.S. Cl. ..... 175/4.52; 175/4.54; 166/55

[58] Field of Search ..... 175/4.51, 4.52, 4.54, 175/4.95, 2, 4.5; 166/55.1, 55.2, 297, 55; 102/312, 313

[56] References Cited

U.S. PATENT DOCUMENTS

| | | | |
|---|---|---|---|
| 3,612,189 | 10/1971 | Brooks et al. | 175/4.54 |
| 4,509,604 | 4/1985 | Upchurch | 175/4.52 |
| 4,531,590 | 7/1985 | Peterson | 175/4.52 |
| 4,541,486 | 9/1985 | Wetzel et al. | 166/297 |
| 4,598,776 | 7/1986 | Stout | 175/4.54 |
| 4,655,283 | 4/1987 | Pritchard, Jr. | 166/55.1 |

*Primary Examiner*—Terry L. Melius

*Attorney, Agent, or Firm*—Rosenblatt & Associates

[57] ABSTRACT

A well perforating gun provides a full bore passage for fluids and tools through the discharged gun without increasing the normal exterior diameter of the gun. The full bore passage is disposed eccentrically within a tubular housing and the perforating guns are mounted in a longitudinally spaced array on one or more elongated strips disposed adjacent elongated slots in the wall of the housing opposite the eccentric portion of the full bore fluid passage.

7 Claims, 1 Drawing Sheet

WELL PERFORATING GUN

BACKGROUND OF THE INVENTION

1. Field of the Invention:

The invention relates to a perforating gun for use in subterranean wells, and particularly to a perforating gun that will provide a full bore fluid or tool passage through the gun after discharge of the gun.

2. Summary of the Prior Art:

For many years the desirability of utilizing a subterranean well bore having a nonvertical or horizontal portion traversing a production formation, has been known and appreciated. Laterally directed bores are drilled regularly, usually horizontally, from the primary well bore to increase contact with the production formation which normally extends in a generally horizontal direction. When conventional vertical well bores are employed to tap wide area production formations, a large number of vertical bores must be employed. With the drilling of the well by having a non-vertical portion, even including a substantially horizontal portion, traversing the production formation, a much greater area of the production formation may be traversed by the well bore and drilling costs may be substantially decreased, After the horizontal well bore has produced all of the economically producible hydrocarbons, the same vertical well bore may be drilled to establish a horizontal portion extending in another direction and thus prolong the utility of the vertical portion of the well and increase the productivity capability of the well to include substantial areas of the production formation.

When a deviated well bore is extended into a production formation in a generally horizontal direction, it is no longer desirable to effect perforation of the well bore around the 360° periphery of the well bore, as is the case in conventional vertical well bores. The reason for this is that upwardly directed perforations provide an opportunity for debris to fall into the fluid passage provided for removing production fluid from the perforated formation, and such debris tends to clog tool elements incorporated in the tubing string.

Special angular aligning arrangements have been heretofore proposed for insuring that the perforations are downwardly and horizontally directed.

A further problem arises in the utilization of conventional perforating guns in deviated well bores in that the disposition of the fired gun becomes a problem. In a normal vertical well, a vertical extension of the well, commonly called a "rat hole", is normally drilled to a sufficient depth beyond all production formations to permit the discharged gun to be dropped into the rat hole after the gun is fired and remain there. With a deviated well bore, particularly one traversing a production formation in a generally horizontal direction, the end of the formation may be many thousands of feet away from the region to be perforated and it is not desirable to fill up any portion of the well bore traversing a production formation with the discharged gun because subsequent operations may require those tool-filled portions be used for production. Additionally, there is a recognized problem that with a well bore having a horizontal or a slightly inclined configuration relative to the horizontal, there is little opportunity for a discharged perforating gun to drop any substantial distance before it becomes wedged in the well bore.

One last problem, which exists in conventional vertical wells as well as deviated wells, is that it is occasionally desirable to achieve the hydraulic fracturing of a perforated formation immediately after the firing of the perforating gun. This requires the transmission of a high pressure fracturization fluid to the perforated production zone of the well.

It is therefore highly desirable that a full bore passage be provided through a discharged perforating gun in order to conduct such high pressure fluid to the desired position for effecting a fracturization of the well bore. Furthermore, it is often desirable to insert other well tools, such as pressure and flow measuring indicators in the well bore beyond the perforating gun, and the conventional perforating gun, when discharged, interferes with the passage of such additional well tools.

There is therefore a definitive need in the oil well drilling industry for a perforating gun construction that will solve all of the aforementioned problems.

SUMMARY OF THE INVENTION

This invention contemplates a perforating gun having a full bore fluid passage formed within a tubular housing which is of the same general external dimensions as conventional perforating guns. The full bore fluid passage is accomplished by an eccentric portion disposed in the medial portion of the tubular housing and thus defining a gun mounting chamber between the interior bore of the housing and the exterior of the eccentric portion of the full bore fluid passage. One or more strips of longitudinally spaced guns are mounted in this gun mounting chamber, preferably adjacent to longitudinal slots formed in the wall of the tubular housing. Thus, the guns, when fired, will not fire in a 360° direction but will be limited to firing essentially throughout a 180° extent relative to the axis of the well bore. This limitation is of particular advantage in effecting the perforation of deviated well bores which traverse production formations in a generally horizontal direction. Additionally, there is no need to dispose of the discharged gun because the full bore eccentric flow passage provided in the gun housing permits the passage of pressured fracturing fluid to any production formation existing below the location of the discharged gun, which can be readily moved upwardly after discharge. Additionally, the full bore fluid passage permits the unimpeded passage of tools through the discharged gun to effect measurements or treatment of the well bore below the discharged gun.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
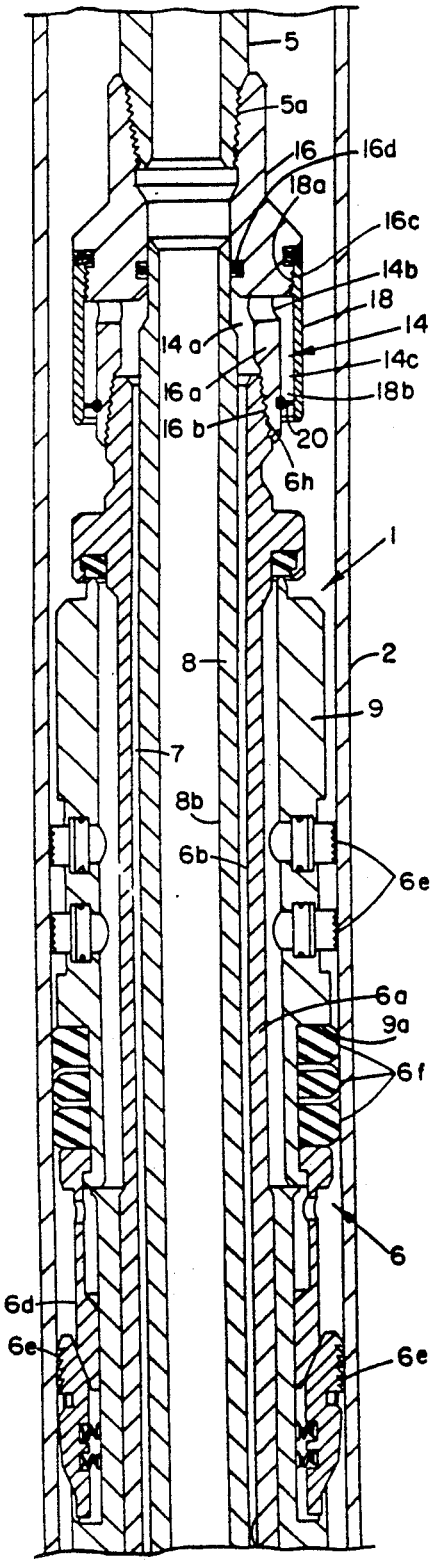
FIGS. 1A and 1B collectively comprise a vertical sectional view of a packer and perforating gun embodying this invention.
Figure 1B:
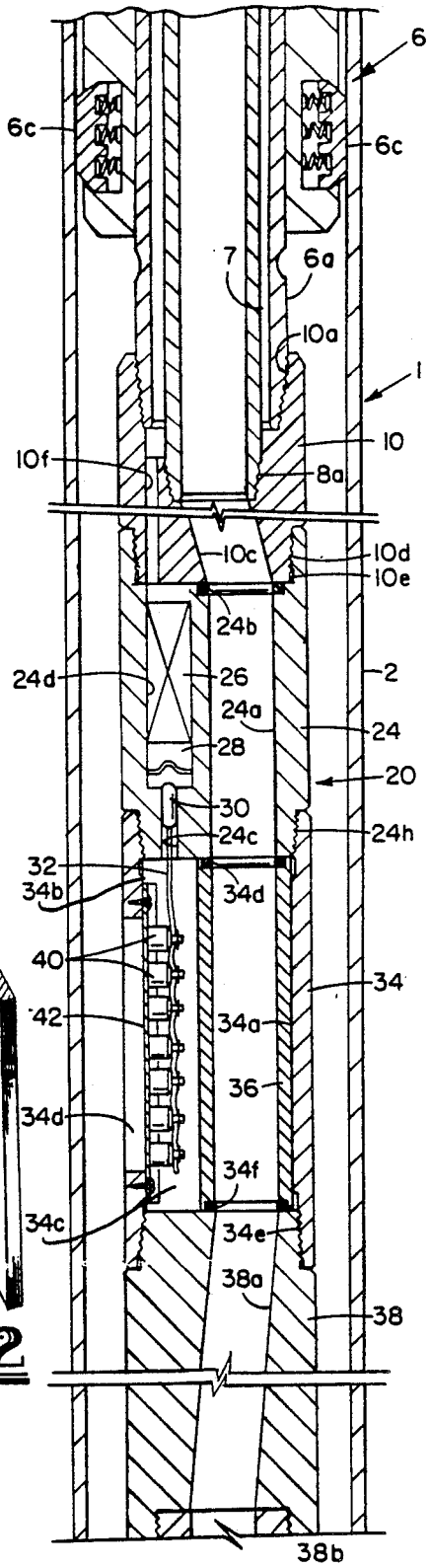

Referring to FIGS. 1A and 1B, there is shown a packer 6 set within the bore of a casing 2 and having a perforating gun 20 embodying this invention depending from the set packer. While not shown, the casing 2 may well be disposed in a substantially horizontal position if the particular well bore includes a deviated portion horizontally traversing a production formation. Packer 6 is suspended on the lower end of a tubing string 5 which extends to the well surface. Packer 6 may comprise any conventional type that is settable either by manipulation of the tubing string or through the application of fluid pressure. For this reason, the particular setting mechanism is not disclosed.

Packer 6 has a tubular housing portion 6*a* which is secured by threads 6*b* to the bottom end of a top sub 16, which is secured to tubing string 5 by threads 5*a*. A central body sleeve 8 is sealably engaged with the bore of top sub 16 by an O-ring 16*d* and at its bottom end is secured by threads 8*a* to a gun connecting sub 10. Connecting sub 10 is secured by threads 10*a* to the bottom of tubular housing 6*a*. Central body sleeve 8 defines a central fluid passage 8*b* which is substantially the same diameter as the bore of the tubing string 5.

Packer 6 is further provided at the lower end of housing portion 6*a* with a plurality of peripherally spaced conventional spring pressed drag block assemblies 6*c*. Above the drag block assemblies 6*c*, packer 6 is further provided with slips 6*e* which are wedged into biting engagement with the inner wall of casing 2 by a cone element 6*d* surrounding body portion 6*a*. Above the cone element 6*d*, a plurality of axially adjacent elastomeric sealing elements 6*f* are provided which are compressed into sealing engagement with the bore of casing 2 by a shoulder 9*a* formed on a compression housing 9 which surrounds the tubular housing portion 6*a*. If desired, a plurality of peripherally spaced spring pressed anchors 6*e* may be mounted in compression housing 9 to also engage the bore of casing 2. All of these elements are conventional and require no further description.

An axially extending fluid passage 7 is provided extending through the length of the packer 6. Such fluid passage may comprise an annular passage disposed between packer central sleeve 8 and the internal bore 6*b* of the packer tubular housing 6*a*. The axially extending annular fluid passage 7 terminates at its upper end in a generally U-shaped cross section, annular fluid passage 14 having a short upwardly extending leg 14*a*, a plurality of peripherally spaced radial ports 14*b* and a downwardly extending annular passage 14*c*. The annular U-shaped fluid passage 14 is defined by top sub 16 and a cover sleeve 18 which is secured to the exterior of the top sub 16 by threads 16*c* and O-ring 16*d*.

Top sub 16 comprises a lower reduced thickness portion 16*a* having internal threads 16*b* cooperating with packer threads 16*b*. The annular space between the reduced thickness portion 16*a* and the exterior surface of sleeve 8 defines the upwardly extending leg 14*a* of the U-shaped annular fluid passage 14. The radially extending ports 14*b* are formed in the top end of the reduced thickness portion 16*a* of the top sub 16. The internal bore 18*b* of the cover sleeve 18 is disposed in radially spaced relationship to the exterior of the reduced thickness portion 16*a* of the sleeve element 16 and defines the downwardly extending leg 14*c* of the U-shaped annular fluid passage 14.

Adjacent the downwardly facing opening of the downwardly extending leg 14*c*, an annular wiping seal 20 is provided. This seal comprises a flexible plastic T seal which is effective to retain a clean fluid within the annular U-shaped passage 14 and the axial passage 7.

Perforating gun 20 comprises the upper connecting sub 10 which has been described previously. An inclined fluid passage 10*c* is provided in the upper connecting sub 10 and communicates at its top end with the central bore 8*b* which extends upwardly through the packer 6.

The top end of fluid passage 10*c* is concentric with the tool axis, while the bottom end is eccentric. Passage 10*c* is of the same diameter as the central bore 8*b* of the packer 6 but is inclined at an angle to the vertical. The extent of such inclination is exxagerated in the drawings for the purpose of conserving space, but those skilled in the art will recognize that the deviation from its concentric top end to its eccentric lower end of the angularly inclined bore 10*c* is accomplished over a substantial length of the upper sub 10.

The lower end of upper sub 10 is provided with external threads 10*d* which are engagable with a tubular housing 24 which is employed for mounting a detonator for the perforating gun. Threads 10*d* are sealed by an O-ring 10*e*. The detonator housing 24 is provided with an eccentric bore 24*a* which communicates at its upper end with the bottom end of the inclined bore 10*c*. A suitable seal 24*b* is provided to prevent leakage at this juncture.

In the remaining body portion of the detonator housing 24, an upwardly opening counterbore 24*d* of an axially extending bore 24*c* is provided which communicates with an axial fluid passage 10*f* in upper sub 10 which in turn communicates with the axial fluid passage 7. The counterbore 24*d* accommodates in its upper portions a conventional fluid pressure operated detonator 26 which is activatable through the application of annulus fluid pressure from axial fluid passages 7 and 10*f*. Such detonator is of conventional construction and may, for example, comprise the annulus pressure operated detonator described in U.S. Pat. Nos. 4,667,735 and 4,606,409. Below detonator 26, a downwardly facing shaped charge 28 is mounted and, when detonated by detonator 26, produces a downwardly directed gaseous blast which impinges on a booster charge 30 in bore 24*c* which in turn is connected to one or more primer cords 32 leading to a plurality of perforating guns 40, as will be described.

The lower end of detonator housing 24 is provided with external threads 24*h*. A gun housing 34 is secured to the threads 24*h*. Such gun housing has an eccentric fluid passage 34*a* formed therein communicating with eccentric passage 24*a* and sealed by seal 34*d*. For simplicity of illustration, the fluid passage 34*a* may be defined by a pipe 36 which has one longitudinal edge thereof welded to the internal bore of the gun housing 34. The bore of eccentric passage 34*a* is substantially equal to the bore of the tubing string 5.

Figure 2:
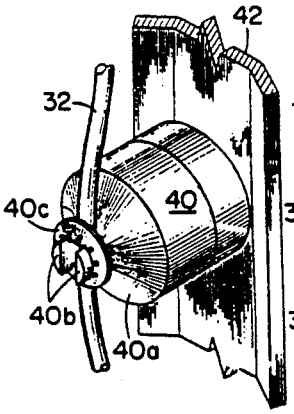
FIG. 2 is an enlarged scale sectional view of a single perforating element.

The space between the outer wall of pipe 36 and the remainder of bore 34*b* of the gun housing 34 thus defines a chamber 34*c* for mounting a plurality of perforating guns. The wall of gun housing 34 is provided with a plurality of peripherally spaced longitudinal slots 34*d*. The perforating guns 40 are mounted in longitudinally spaced relationship on a mounting strip 42 which is secured by bolts 29 to the wall of gun housing 34 so that the discharge ends of the guns 40 are disposed opposite the slots 34*d*. The primer cord 32 extending downwardly from the detonator mechanism is secured to the ignition ends of each of the perforating guns 40 in the manner described in U.S. Pat. No. 4,852,495 and illustrated in enlarged scale view of FIG. 2. Briefly, the conical ends 40*a* of each of the perforating guns 40 are provided with two axially extending projections 40*b* defining a groove for receiving the primer cord 32. A crimping washer 40c is then snapped into an annular groove (not shown) formed on the axial projections 40b to secure the primer cord 32 onto the respective perforating gun 40.

It will be readily apparent that, depending on the dimensions of the casing 2, as many as three or four strips of perforating guns 40 can be mounted in the gun mounting chamber 34c defined between the exterior of the eccentric fluid passage 34a and the opposite wall portion of the gun mounting housing 34. A separate primer cord (not shown) would extend from booster charge 30 to each of the strips of perforating guns.

Thus, the total discharge arc of the blasts from the plurality of perforating guns would be somewhat less than 180° and thus would be ideal for use in a deviated well bore, particularly one that is substantially horizontal, to produce only downwardly directed perforations into the production formation.

The lower end of the gun mounting housing 34 is provided with internal threads 34e which mount a transition sub 38 which defines an inclined fluid passage 38a of the same bore as the bore of the tubing string 5. The eccentric fluid passage 34a is sealably connected to inclined passage 38a sealed by an O-ring 34f. The lower end of the passage 38a of the transition sub 38 is concentric with the axis of the well bore. Thus a full bore fluid passage is provided through the packer and the perforating gun permitting the passage of pressured fluid through such full bore passage to operate on production formations disposed below the discharged perforating gun. The lower end of transition sub 38 is provided with internal threads 38b for connection to any additionally desired tools. If treatment of the formation perforated by guns 40 is desired, the packer 6 may be unset and moved upwardly to provide convenient access to the newly perforated zone.

Thus, not only is a full bore fluid passage provided through the perforating gun, both before and after its discharge, but the discharge of the perforating guns is limited to an arc of not more than 180°. Furthermore, if desired, tools may be passed down through the full bore passage thus provided. The advantages of such arrangement, which completely eliminates the necessity of removing the discharged perforating gun from the well bore, will be readily apparent to those skilled in the art.

Although the invention has been described in terms of a specific embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A perforating gun for insertion into a wellbore into a formation, comprising:

a tubular housing;

a tubular element, defining a flow passage, extending uninterruptedly over the length of said housing in flow communication with both ends of said tubular housing and providing an opening at its extremities of similar cross-sectional open area as the cross-sectional area of said flow passage within said tubular housing;

a gun chamber defined between said flow passage and said tubular housing;

a plurality of perforating elements so arranged within said gun chamber so that their firing orientation does not exceed a formation penetration of about 180 degrees measured from the longitudinal axis of said tubular housing;

detonating means mounted at least in part in said gun chamber and outside and independent of said tubular element for selective detonation of said perforating elements;

said tubular element remaining unobstructed before, during, and after activation of said detonating means; and whereupon, subsequent to said actuation of said detonating means, said flow passage is broad enough to permit insertion of well tools therethrough.

2. The apparatus of claim 1, further comprising a packer disposed for selective sealing contact with the wellbore and mounted adjacent said tubular housing.

3. The apparatus of claim 2, wherein:

said perforating elements are mounted to at least one elongated mounting structure;

said tubular housing providing at least one elongated slot in alignment with said elongated mounting structure;

said perforating elements oriented for firing through said slot.

4. A perforating gun for insertion into a wellbore into a formation, comprising:

a tubular housing;

a tubular element, defining a flow passage, extending uninterruptedly over the length of said housing in flow communication with both ends of said tubular housing and providing an opening at its extremities of similar cross-sectional open area as the cross-sectional area of said flow passage within said tubular housing;

a gun chamber defined between said flow passage and said tubular housing;

a plurality of perforating elements so arranged within said gun chamber so that their firing orientation does not exceed a formation penetration of about 180 degrees measured from the longitudinal axis of said tubular housing;

detonating means mounted at least in part in said gun chamber for selective detonation of said perforating elements;

whereupon, subsequent to said actuation of said detonating means, said flow passage is broad enough to permit insertion of well tools therethrough;

a packer disposed for selective sealing contact with the wellbore and mounted adjacent said tubular housing;

said perforating elements are mounted to at least one elongated mounting structure;

said tubular housing providing at least one elongated slot in alignment with said elongated mounting structure;

said perforating elements oriented for firing through said slot;

bypass means operable through said packer and into said gun chamber for actuation of said denoting means by fluid pressure in the wellbore.

5. The apparatus of claim 4, wherein said flow passage is concentric with said tubular housing at its extremities and eccentric therebetween.

6. A perforating gun for insertion into a wellbore into a formation, comprising:

a tubular housing;

a tubular element, defining a flow passage, extending uninterruptedly over the length of said housing in flow communication with both ends of said tubular housing and providing an opening at its extremities of similar cross-sectional open area as the cross-sectional area of said flow passage within said tubular housing;

a gun chamber defined between said flow passage and said tubular housing;

a plurality of perforating elements so arranged within said gun chamber so that their firing orientation does not exceed a formation penetration of about 180 degrees measured from the longitudinal axis of said tubular housing;

detonating means mounted at least in part in said gun chamber for selective detonation of said perforating elements;

whereupon, subsequent to said actuation of said detonating means, said flow passage is broad enough to permit insertion of well tools therethrough;

a packer disposed for selective sealing contact with the wellbore and mounted adjacent said tubular housing;

bypass means operable through said packer and into said gun chamber for actuation of said denoting means by fluid pressure in the wellbore.

7. The apparatus of claim 6, wherein said flow passage is concentric with said tubular housing at its extremities and eccentric therebetween.

* * * * *